US006951387B2

(12) United States Patent
Carrese et al.

(10) Patent No.: US 6,951,387 B2
(45) Date of Patent: Oct. 4, 2005

(54) INK TANK WITH CAPILLARY MEMBER

(75) Inventors: Edward M. Carrese, Rochester, NY (US); David P. Breemes, Sr., Palmyra, NY (US); Michael Cook, Waterloo, NY (US); Douglas J. Baxendell, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/248,382

(22) Filed: Jan. 15, 2003

(65) Prior Publication Data

US 2004/0135855 A1 Jul. 15, 2004

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS

| | | | | | |
|---|---|---|---|---|---|
| 4,126,868 | A | * | 11/1978 | Kirner | 347/92 |
| 4,368,478 | A | * | 1/1983 | Koto | 347/86 |
| 5,233,369 | A | | 8/1993 | Carlotta et al. | |
| 5,289,212 | A | | 2/1994 | Carlotta | |
| 5,420,625 | A | | 5/1995 | Dietl et al. | |
| 5,479,968 | A | | 1/1996 | Sanchez et al. | |
| 5,486,855 | A | | 1/1996 | Carlotta et al. | |
| 5,491,501 | A | | 2/1996 | Dietl et al. | |
| 5,519,425 | A | | 5/1996 | Dietl et al. | |
| 5,563,643 | A | | 10/1996 | Carlotta et al. | |
| 5,657,065 | A | | 8/1997 | Lin | |
| 5,696,546 | A | | 12/1997 | Narang et al. | |
| 5,742,312 | A | * | 4/1998 | Carlotta | 347/87 |
| 5,786,834 | A | | 7/1998 | Carlotta et al. | |
| 5,821,966 | A | | 10/1998 | Schell et al. | |
| 5,898,449 | A | | 4/1999 | Narang et al. | |
| 5,949,458 | A | * | 9/1999 | Studholme | 347/86 |
| 5,959,649 | A | * | 9/1999 | Dietl et al. | 347/87 |
| 5,971,531 | A | | 10/1999 | Dietl et al. | |
| 6,000,788 | A | * | 12/1999 | Iida | 347/86 |
| 6,186,621 | B1 | * | 2/2001 | Pew | 347/86 |
| 6,293,663 | B1 | * | 9/2001 | Koshikawa et al. | 347/86 |
| 6,431,698 | B1 | * | 8/2002 | Mou et al. | 347/86 |
| 6,447,109 | B1 | * | 9/2002 | Williamson et al. | 347/85 |
| 6,464,347 | B2 | | 10/2002 | Kneezel et al. | |
| 6,490,792 | B1 | * | 12/2002 | Ishinaga et al. | 29/890.1 |
| 6,523,946 | B2 | * | 2/2003 | Mou et al. | 347/86 |
| 6,536,861 | B1 | * | 3/2003 | Usui et al. | 347/7 |
| 6,550,900 | B2 | * | 4/2003 | Chan et al. | 347/86 |
| 6,585,358 | B2 | * | 7/2003 | Usui et al. | 347/85 |
| 6,585,360 | B1 | * | 7/2003 | Dietl | 347/86 |
| 6,802,602 | B2 | * | 10/2004 | Sakai et al. | 347/86 |

FOREIGN PATENT DOCUMENTS

| | | | | |
|---|---|---|---|---|
| EP | 0 581 531 A1 | | 2/1994 | |
| EP | 1142719 | * | 10/2001 | B41J/2/175 |
| JP | 40596743 | * | 4/1993 | B41J/2/175 |
| JP | 405096744 A | * | 4/1993 | B41J/2/175 |
| WO | WO 01/49495 A1 | | 7/2001 | |

* cited by examiner

*Primary Examiner*—Anh T.N. Vo
(74) *Attorney, Agent, or Firm*—Oliff & Berridge, PLC

(57) ABSTRACT

An ink tank comprises a housing that defines a container for ink that is substantially free from a negative pressure producing material. In various embodiments, a non-porous capillary member is disposed in the container. The capillary member may be formed by part of the housing, for example, by a channel formed in a side wall of the housing. Alternatively, the capillary member may be a capillary tube. A wick may be situated at an outlet formed in the housing and may be held there by a retaining member, for example, a rib that extends from the housing. The housing may include a cover that allows the container to vent to atmosphere. The cover may include a vent hole that communicates with the container via a tortuous path. Part of the cover may comprise an air permeable material. The housing may also define a spillover area outside of the container.

30 Claims, 12 Drawing Sheets

INK TANK WITH CAPILLARY MEMBER

BACKGROUND OF THE INVENTION

1. Field of Invention

This invention relates to ink tanks for print heads, ink jet cartridges, and the like.

2. Description of Related Art

Print heads may be formed as an integral part of an ink tank or cartridge, or they may be formed as part of a print head ink tank support structure into which one or more individual ink tanks or cartridges may fit. An example of an ink jet print cartridge, as described in U.S. Pat. No. 5,821,966 to Schell et al., is shown in cross section in FIG. 1. The cartridge 10 comprises an ink container 22 an associated print head 24. An outlet port 35 is formed in the ink container 22. A manifold member 42 that provides for ink flow from the ink container 22 to the print head 24 is inserted into the outlet port via an ink pipe 46A. The ink container 22 contains an ink impregnated foam member 40, which may be a closed cell neoprene, that is compressed by the ink pipe 46A in the operative position shown. Various other designs of ink tanks are known that use a negative pressure producing material in the ink tank.

SUMMARY OF THE INVENTION

This invention is directed to an ink tank that avoids various disadvantages and drawbacks associated with the use of a negative pressure producing material in the ink tank. A "foamless" design having little or no negative pressure producing material in the ink tank is contemplated by this invention.

This invention provides improved ink retention and/or reduces ink spillage.

This invention separately provides improved ink delivery and/or reduced delivery of air with the ink.

This invention separately provides improved pressure for ink retention and/or delivery.

This invention separately provides reduced pressure fluctuations for improved performance.

This invention separately provides improved operation of print heads and/or related devices, such as, for example, ink level detectors.

This invention separately provides improved ink tank fill methods.

This invention separately provides reduced initial air bubble size in ink tanks.

This invention separately provides reduced complexity in manufacturing ink tanks.

This invention separately provides reduced costs in manufacturing ink tanks.

This invention separately provides improved recycling, refilling and/or reusing of ink tanks.

Various exemplary embodiments of this invention provide an ink tank comprising a housing that defines a container for ink and a non-porous capillary member disposed in the container. The capillary member may be formed by part of the housing and may be a capillary tube.

In various exemplary embodiments, a wick may be situated at an outlet formed in the housing. The wick may be made of a high density felted foam, compressed felt, foam rubber, foam plastic, a needled felt material, a woven material, a "polysorb" material (a dense, highly absorbent material with high capillarity), a scavenger material, a metal and/or a molded plastic. The wick may be a foam pad, a filter, a microscreen, a micro-pore structure or a combination thereof.

In various exemplary embodiments in which a wick is situated at the outlet, the housing may include a rib extension that retains the wick or holds the wick in place. Further, in various exemplary embodiments, the wick may be formed as part of the housing.

These and other features and advantages of this invention are described in or are apparent from the following detailed description of various exemplary embodiments according to this invention.

DETAILED DESCRIPTION OF EXEMPLARY EMBODIMENTS

This invention may be applied to various ink tank configurations and is not limited to the particular configurations disclosed by the exemplary embodiments. Those skilled in the art will appreciate that a "foamless" ink tank in accordance with this invention without including all of the particular features disclosed by the exemplary embodiments.

Figure 1:
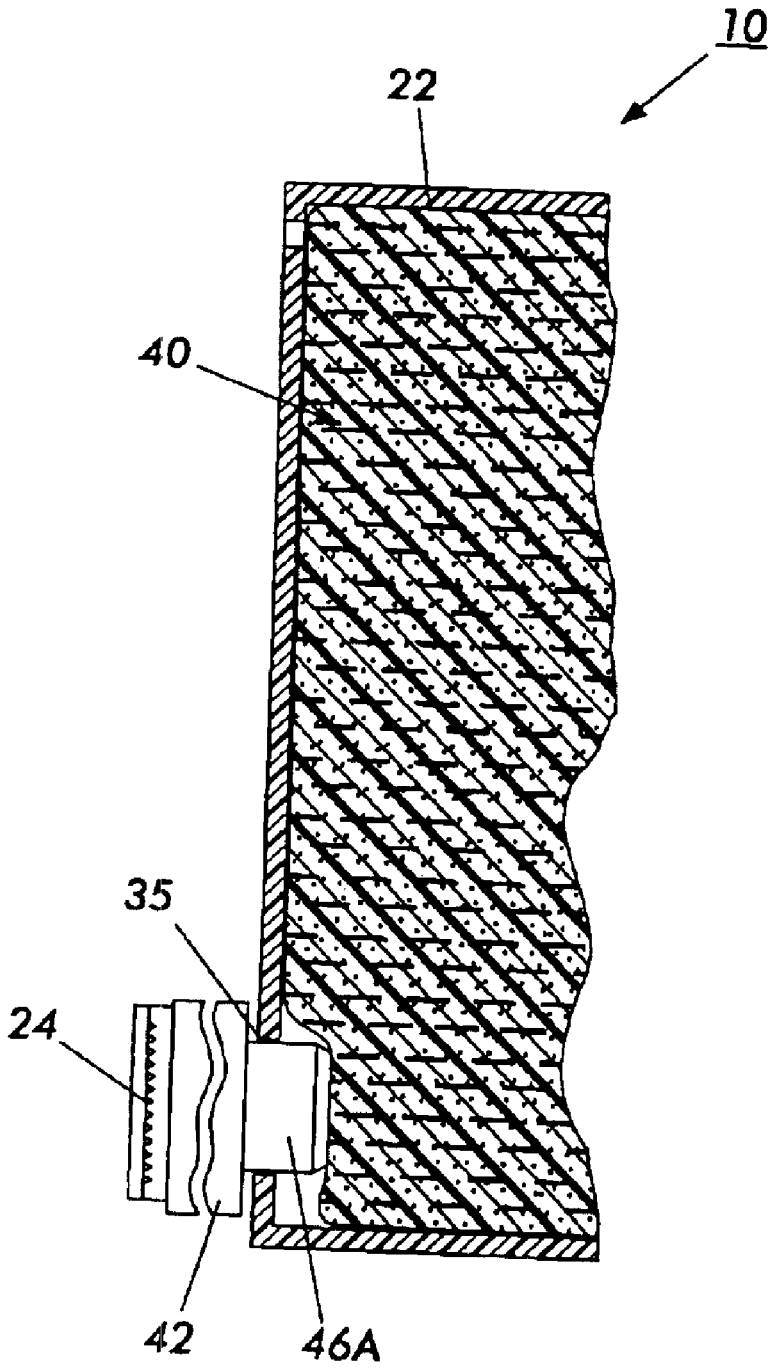
FIG. 1 Prior Art
FIG. 1 is a partial cross sectional view of a known ink tank and print head.
Figure 2:
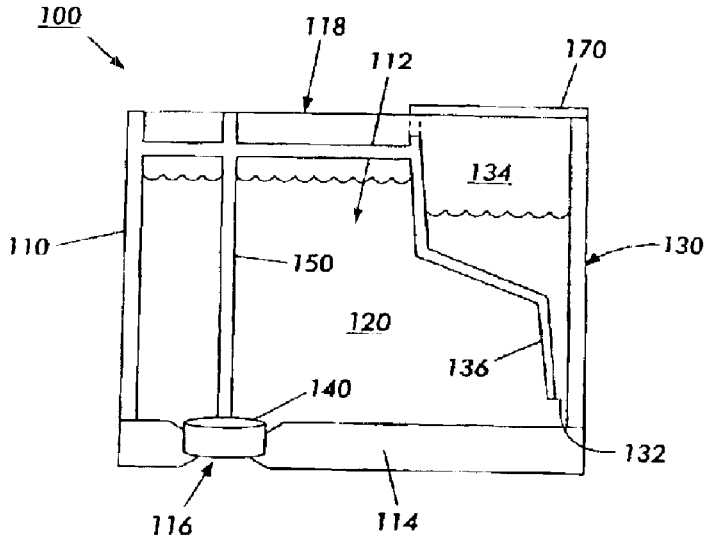
FIG. 2 is a cross sectional view of a first exemplary embodiment of an ink tank according to this invention.
Figure 3:
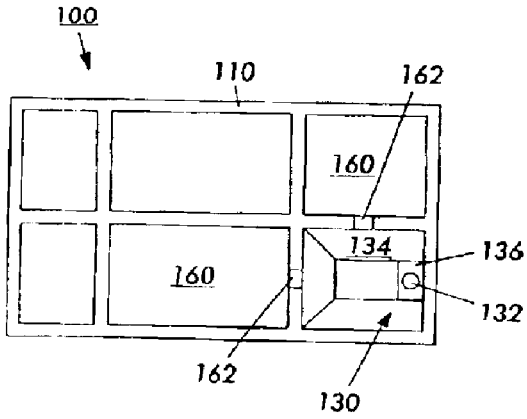
FIG. 3 is a top view of the first exemplary embodiment with the seal removed.

FIGS. 2–3 illustrate a first exemplary embodiment of an ink tank 100 according to this invention. The ink tank 100 comprises a housing 110 that defines a container 112 for a supply of ink 120. The ink tank 100 includes at least one capillary member 130 with an opening 132 located toward a bottom side 114 of the housing 110. The capillary member 130 may comprise a reservoir 134 with a capillary section or tube 136 disposed between the reservoir 134 and the opening 132. The bottom side 114 may be formed integrally or may be a cover that is attached to the housing 110 in a sealing manner, for example, by welding.

As shown in FIG. 2, the capillary member 130 may be formed as part of the housing 110. However, the capillary member 130 may also be formed as a separate element that is disposed in the container 112 defined by the housing 110.

An outlet 116 is formed in the bottom side 114 for dispensing the ink 120 on demand. A wick 140 is provided at the outlet 116 to aid in the retention of the ink 120 in the container 112 and in the dispensing of the ink 120 from the container 112. The wick 140 may be retained or held in place in any suitable manner or by any suitable mechanism. For example, as shown in FIG. 2, the wick 140 may be retained or held in place at the outlet 116 by a rib 150. The rib 150 may be formed as part of the housing 110. However, the rib 150 may also be formed as a separate element that is disposed in the container 112 and attached to the housing 110.

As shown in FIGS. 2 and 3, one or more spillover areas 160 may be defined by a top side 118 of the housing 110 outside of the container 112 and placed in fluid communication with the reservoir 134 of the capillary member 130 by one or more holes 162. The spillover areas 160 may provide protection against undesirable leakage of the ink 120 from the ink tank 100 by providing a place for the ink 120 to flow under various conditions, such as a rapid change in temperature or a change in altitude, which result in a pressure difference between the inside and outside of the ink tank 100.

As shown in FIG. 2, at least part of the top side 118 of the housing 110 is covered by a air permeable layer 170. The air permeable layer 170 is arranged to substantially seal the top side 118 of the housing 110 against spillage of the ink 120 and to allow exposure to atmospheric pressure to reduce potential leakage due to environmental changes, such as altitude and/or temperature. Although not shown, potential leakage of the ink 120 from the ink tank 100 may be further reduced by applying a metalized label to the housing 110.

In the first exemplary embodiment, the capillary member 130 and the wick 140 serve to regulate a negative ink delivery pressure. The capillary member 130 is a non-porous structure. As such, the capillary member 130 and the wick 140 reduce or even eliminate the need for a porous foam material inside the container 112 that holds the ink 120 in conventional ink tanks. By selecting a material of the wick 140 and an equivalent diameter of the capillary member 130, the ink delivery pressure and the static pressure (no demand for ink) of an ink delivery system using the ink tank 100 may be adjusted. For example, using an equivalent diameter of 0.014 inches for the capillary member 130 and a turbo scavenger material for the wick 140, a static pressure of about −2.0 inches of water may be achieved. With an equivalent diameter of 0.019 inches for the capillary member 130, a weaker negative pressure profile is achieved.

Figure 4:
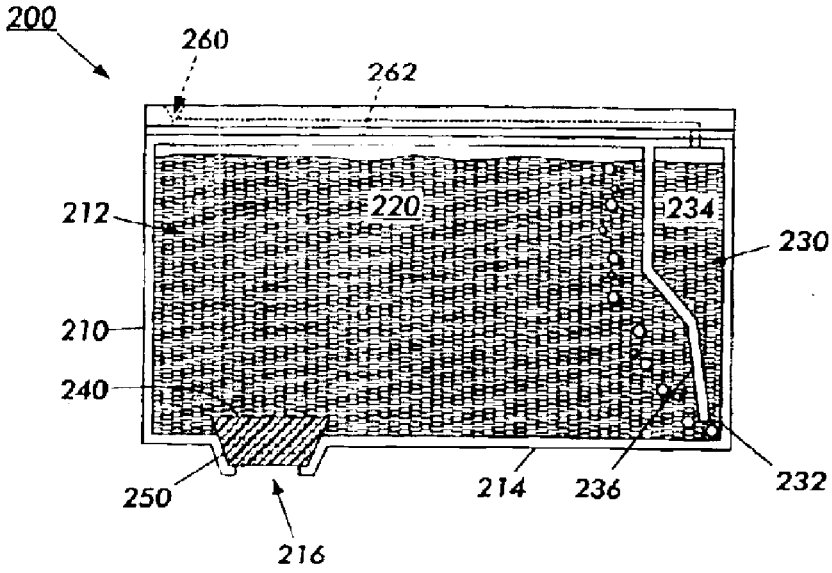
FIG. 4 is a cross sectional view of a second exemplary embodiment of an ink tank according to this invention.
Figure 5:
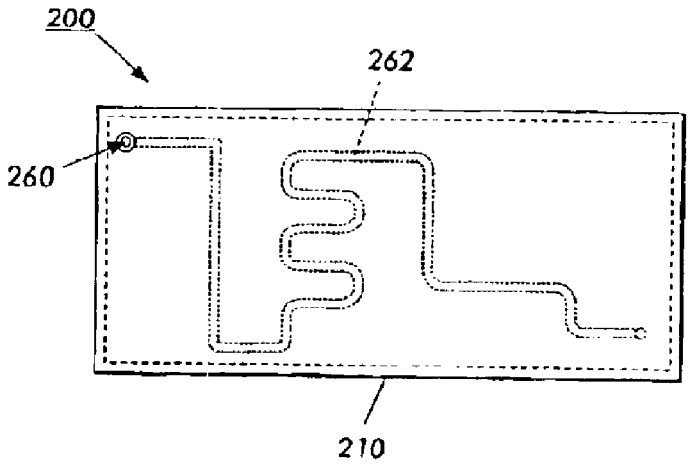
FIG. 5 is a top view of the second exemplary embodiment.

FIGS. 4–5 illustrate a second exemplary embodiment of an ink tank 200 according to this invention. The ink tank 200 comprises a housing 210 that defines a container 212 for a supply of ink 220. The ink tank 200 includes at least one capillary member 230 with an opening 232 located toward a bottom side 214 of the housing 210. The capillary member 230 may comprise a reservoir 234 with a capillary section or tube 236 disposed between the reservoir 234 and the opening 232. In the second exemplary embodiment, the bottom side 214 is formed integrally with the housing 210.

As shown in FIG. 4, the capillary member 230 is formed as part of the housing 210. An outlet 216 is formed in the bottom side 214 for dispensing the ink 220 on demand. A wick 240 is provided at the outlet 216 and is retained or held in place at the outlet 216 by a shaped recess 250. The shape and or size of the recess 250 and the corresponding wick 240 may vary depending on the application or certain design considerations.

As shown in FIGS. 4 and 5, a vent hole 260 connects the reservoir 234 of the capillary member 230 to atmosphere via a tortuous path 262 defined in a top cover 218 of the housing 210. The tortuous path 262 may be of any suitable configuration or geometry that reduces or minimizes moisture and vapor transfer rate or MVTR, the rate at which moisture and vapor permeate through materials, and reduces the rate at which the ink 220 is lost by permeation and/or evaporation. The top cover 218 may be connected to the housing 210 in a sealing manner, for example, by welding, to protect against undesirable leakage of the ink 220. The vent hole 260 and tortuous path 262 also provide protection against undesirable leakage of the ink 220 from the ink tank 200 by allowing exposure to atmospheric pressure to reduce potential leakage due to environmental changes, such as altitude and/or temperature. The tortuous path 262 provides additional containment volume while providing resistance to inward airflow and reduced evaporation losses.

In the second exemplary embodiment, the capillary member 230 and the wick 240 serve the same purpose as described above.

FIGS. 6–10 show various exemplary embodiments of a wick that may be used with an ink tank according to this invention. While various examples are provided by these embodiments, they are not exhaustive. Various other materials and/or configurations for the wick may be used according to this invention. Any of the materials disclosed in U.S. Pat. Nos. 5,971,531, 5,959,649, 5,519,425, 5,491,501 and 5,420,625 to Dietl et al., U.S. Pat. Nos. 5,786,834, 5,563,643, 5,486,855 and 5,233,369 to Carlotta et al., U.S. Pat. Nos. 5,898,449 and 5,696,546 to Narang et al., U.S. Pat. Nos. 5,742,312 and 5,289,212 to Carlotta, U.S. Pat. No. 5,479,968 to Sanchez et al. and U.S. Pat. No. 5,657,065 to Lin, each of which is incorporated by reference in its entirety, may be used for the wick. Further, the wick may be a filter such as that disclosed in U.S. Pat. No. 6,464,347 to Kneezel et al., which is incorporated by reference in its entirety.

Figure 6:
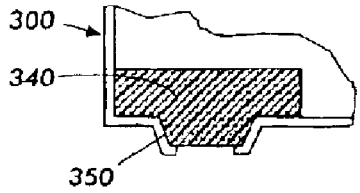
FIG. 6 is a partial cross sectional view of a wick according to a third exemplary embodiment of this invention.

FIG. 6 shows a high density felted foam wick 340 that extends partially beyond a recess 350 into the container of the ink tank 300. The high density felted foam may be of any suitable material, either known or hereafter developed, such as compacted felt, polyurethane foam, compressed natural or synthetic fibers and those described in the incorporated references.

Figure 7:
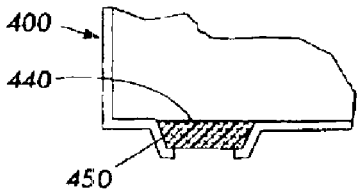
FIG. 7 is a partial cross sectional view of a wick according to a fourth exemplary embodiment of this invention.

FIG. 7 shows a polysorb material wick 440 that does not extend substantially beyond a recess 450 into the container of the ink tank 400. The polysorb material of the wick 440 may be of any suitable material, either known or hereafter developed, such as those described in the incorporated references.

Figure 8:
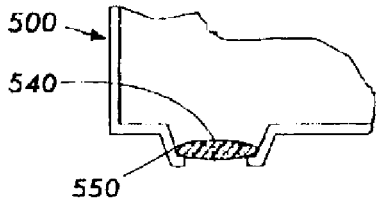
FIG. 8 is a partial cross sectional view of a wick according to a fifth exemplary embodiment of this invention.

FIG. 8 shows a filtering wick 540 that does not extend substantially beyond a recess 550 into the container of the ink tank 500. The wick 540 may comprise a metal microscreen, for example. Alternatively, the filtering material of the wick 540 may be of any suitable material, either known or hereafter developed, such as Gore-Tex®, woven fibers, stainless steel mesh, compacted foam, bundled monofilaments, sintered powdered high density polyethylene or poly propylene and those described in the incorporated references.

Figure 9:
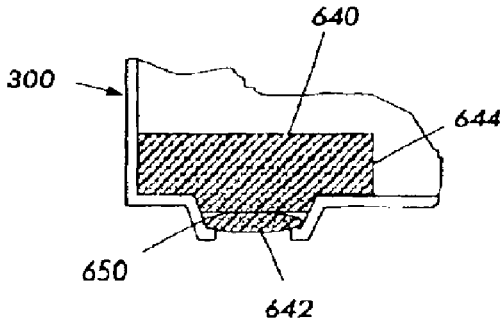
FIG. 9 is a partial cross sectional view of a wick according to a sixth exemplary embodiment of this invention.

FIG. 9 shows a wick 640 comprising a filtering material 642 and a high density felted foam 644 disposed between the filtering material 642 and the container of the ink tank 600 and extending partially beyond a recess 650 into the container.

Figure 10:
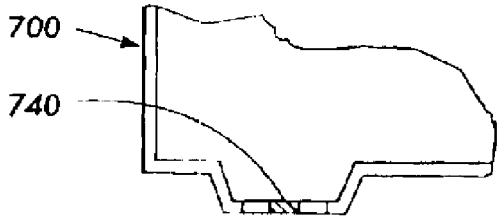
FIG. 10 is a partial cross sectional view of a wick according to a seventh exemplary embodiment of this invention.

FIG. 10 shows a wick 740 comprising a molded micro-pore structure. The wick 740 may be formed integrally with the housing of the ink tank 700. In such a case, the micro-pore structure may be molded from any material suitable for the ink tank 700, either known or hereafter developed, such as polyethylene, polypropylene, Teflon® and those described in the incorporated references. Alternatively, the wick 740 may be formed separately and attached to the housing, for example, by welding, swaging or heat staking. In such a case, the micro-pore structure may be molded from additional materials that may not be suitable for the ink tank 700, such as polyurethane foams and metals.

Figure 11:
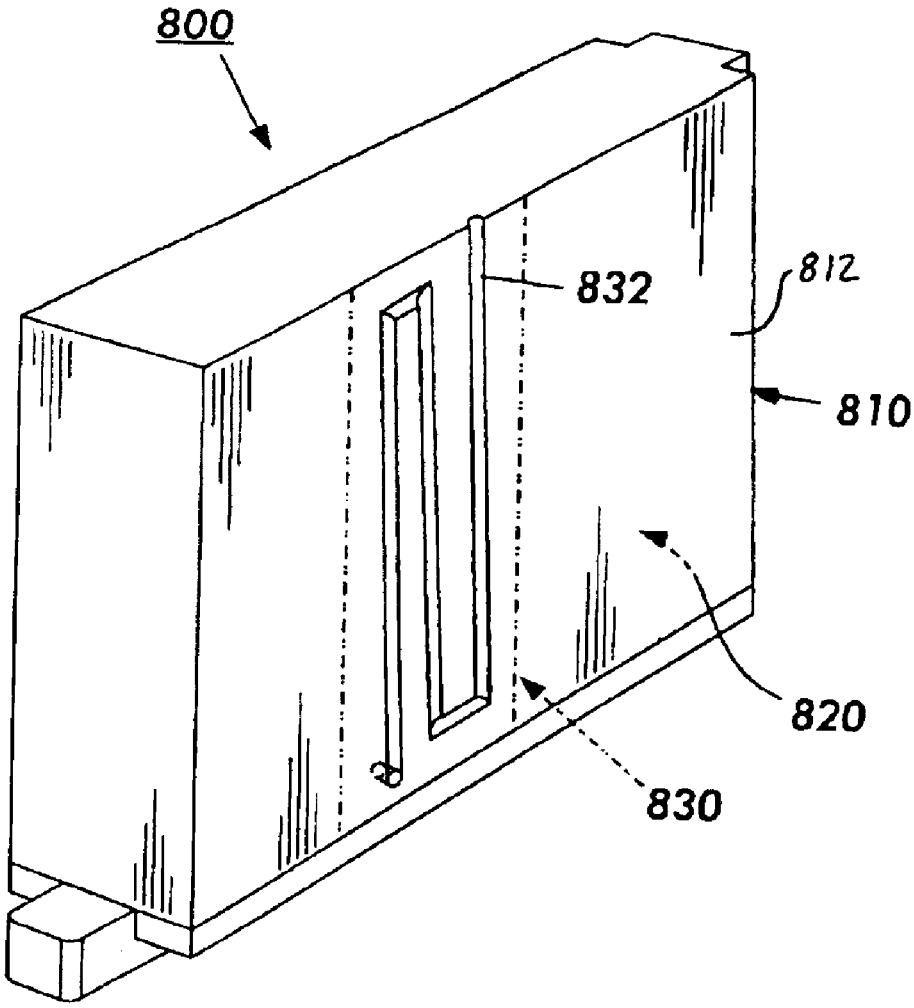
FIG. 11 is a perspective view of an eighth exemplary embodiment of an ink tank according to this invention.
Figure 12:
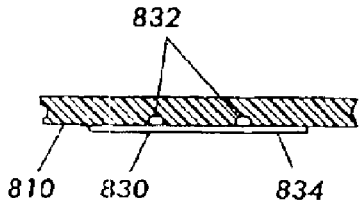
FIG. 12 is a partial top cross sectional view of the eighth exemplary embodiment.

FIGS. 11 and 12 show an eighth exemplary embodiment of an ink tank 800 according to this invention. The ink tank 800 comprises a housing 810 that defines an internal chamber 820 for ink. A capillary member 830 is in fluid communication with the chamber 820 and atmosphere. The capillary member 830 is defined by a tortuous channel or groove 832 formed in a side wall 812 of the housing 810. One of the ends of the channel 832 is in fluid communication with the chamber 820 and the other is in fluid communication with atmosphere. As shown in FIG. 12, a cover 834 is disposed over the channel 832. The cover 834 may be, for example, a metal foil or a plastic film such as mylar or polyethylene.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. An ink tank, comprising:

a housing that defines a container for ink; and a non-porous capillary member at least partially defined by a side wall of the housing; and a wick situated at an ink outlet formed in the housing, wherein the wick and the non-porous capillary member together produce a negative pressure.

2. The ink tank of claim 1, wherein the capillary member comprises a channel formed in the side wall of the housing.

3. The ink tank of claim 1, wherein the capillary member is a capillary tube.

4. The ink tank of claim 1, further comprising a retaining member that holds the wick at the outlet formed in the housing.

5. The ink tank of claim 4, wherein the retaining member comprises a rib that extends from the housing.

6. The ink tank of claim 1, wherein the capillary member has an equivalent inner diameter of 0.019 inches or less.

7. The ink tank of claim 6, wherein the capillary member has an equivalent inner diameter of 0.014 inches or less.

8. The ink tank of claim 1, wherein the container is substantially free from a negative pressure producing material.

9. A method of making an ink tank, comprising:

forming a housing that defines a container for ink; and forming a non-porous capillary member at least partially defined by a side wall of the housing forming an ink outlet in the housing; and forming a wick at the ink outlet, wherein the wick and the non-porous capillary member together produce a negative pressure.

10. The method of claim 9, wherein forming the capillary member comprises forming a capillary tube.

11. The method of claim 9, wherein forming the capillary member comprises forming a channel in a side wall of the housing.

12. The method of claim 9, wherein forming the housing comprises forming the outlet and the wick.

13. The ink tank of claim 12, wherein the capillary member has an equivalent inner diameter of 0.019 inches or less.

14. The ink tank of claim 12, wherein the capillary member has an equivalent inner diameter of 0.014 inches or less.

15. The ink tank of claim 12, wherein the container is substantially free from a negative pressure producing material.

16. The method of claim 9, further comprising selecting a material of the wick and an equivalent diameter of the capillary member to achieve a desired negative pressure.

17. The method of claim 9, further comprising forming a retaining member that holds the wick at the outlet.

18. The method of claim 17, wherein forming the housing comprises forming the retaining member.

19. The ink tank of claim 9, wherein the container is substantially free from a negative pressure producing material.

20. An ink tank, comprising:

a housing that defines a container for ink;

a non-porous capillary member that communicates with the container; and a wick situated at an ink outlet formed in the housing, wherein the wick and the non-porous capillary member together produce a negative pressure.

21. The ink tank of claim 20, further comprising a retaining member that holds the wick at the outlet formed in the housing.

22. The ink tank of claim 21, wherein the retaining member comprises a rib that extends from the housing.

23. The ink tank of claim 20, wherein the capillary member has an equivalent inner diameter of 0.019 inches or less.

24. The ink tank of claim 20, wherein the capillary member has an equivalent inner diameter of 0.014 inches or less.

25. The ink tank of claim 20, wherein the container is substantially free from a negative pressure producing material.

26. A method of making an ink tank, comprising:

forming a housing that defines a container for ink;

forming a non-porous capillary member that communicates with the container;

forming an outlet in the housing; and forming a wick at the ink outlet, wherein the wick and the non-porous capillary member together produce a negative pressure.

27. The method of claim 26, wherein forming the housing comprises forming the outlet and the wick.

28. The method of claim 26, further comprising selecting a material of the wick and an equivalent diameter of the capillary member to achieve a desired negative pressure.

29. The method of claim 26, further comprising forming a retaining member that holds the wick at the outlet.

30. The method of claim 29, wherein forming the housing comprises forming the retaining member.

* * * * *